US007464573B2

(12) United States Patent
Shortridge

(10) Patent No.: US 7,464,573 B2
(45) Date of Patent: Dec. 16, 2008

(54) APPARATUS FOR CURLING AN ARTICLE

(75) Inventor: Jeffrey L. Shortridge, Lynchburg, VA (US)

(73) Assignee: Belvac Production Machinery, Inc., Lynchburg, VA (US)

( * ) Notice: Subject to any disclaimer, the term of this patent is extended or adjusted under 35 U.S.C. 154(b) by 24 days.

(21) Appl. No.: 11/643,934

(22) Filed: Dec. 22, 2006

(65) Prior Publication Data

US 2007/0227218 A1 Oct. 4, 2007

Related U.S. Application Data

(60) Provisional application No. 60/787,502, filed on Mar. 31, 2006.

(51) Int. Cl.
*B21D 51/26* (2006.01)
*B21D 19/12* (2006.01)
*B25C 5/00* (2006.01)

(52) U.S. Cl. ..... 72/94; 72/86; 72/405.03

(58) Field of Classification Search ..... 72/86, 72/87, 94, 101, 110, 111, 124, 126, 107, 72/405.03

See application file for complete search history.

(56) References Cited

U.S. PATENT DOCUMENTS 3,621,530 A * 11/1971 Pflieger et al. ..... 425/3
6,055,836 A * 5/2000 Waterworth et al. ..... 72/110
6,644,083 B2 * 11/2003 Pakker ..... 72/86
6,672,122 B2 * 1/2004 Mustread et al. ..... 72/101
2005/0193796 A1 9/2005 Heiberger et al.

FOREIGN PATENT DOCUMENTS

| | | |
|---|---|---|
| CA | 2 536 841 | 3/2005 |
| JP | 2003-237752 | 8/2003 |
| JP | 2003-251424 | 9/2003 |
| JP | 2003-252321 | 9/2003 |
| JP | 2004-002557 | 1/2004 |
| JP | 2004-130386 | 4/2004 |
| JP | 2004-217305 | 8/2004 |
| JP | 2005-022663 | 1/2005 |
| WO | WO-96/33032 | 10/1996 |
| WO | WO-97/37786 | 10/1997 |

OTHER PUBLICATIONS

U.S. Appl. No. 11/581,787, filed Oct. 17, 2006, Marshall.
U.S. Appl. No. 11/643,935, filed Dec. 22, 2006, Shortridge et al.

(Continued)

*Primary Examiner*—Dana Ross
*Assistant Examiner*—Teresa Bonk
(74) *Attorney, Agent, or Firm*—Foley & Lardner LLP

(57) ABSTRACT

An apparatus for providing a curl on a top edge of a can comprises a forming head; and a forming turret with a push ram to load the can into the forming head. The forming head includes a plurality of independent rollers mounted on a common head. The plurality of rollers includes a first set of rollers configured to form an inner portion of a curl and a second set of rollers configured to form an outer portion of the curl.

33 Claims, 9 Drawing Sheets

OTHER PUBLICATIONS

U.S. Appl. No. 11/643,950, filed Dec. 22, 2006, Marshall et al.
U.S. Appl. No. 11/692,564, filed Mar. 28, 2007, Marshall et al.
U.S. Appl. No. 11/692,584, filed Mar. 28, 2007, Schill et al.

Applicants inform the PTO that an offer for sale was made more than one year before the date of this application of a device represented by the attached Figure ("Exhibit A"). Additional information is available upon request.

* cited by examiner

APPARATUS FOR CURLING AN ARTICLE

CROSS-REFERENCE TO RELATED PATENT APPLICATIONS

This application claims the benefit under 35 U.S.C. §119 (e) of U.S. Provisional Application No. 60/787,502, filed Mar. 31, 2006, which is incorporated herein by reference in its entirety.

BACKGROUND

The present invention relates generally to the field of forming or processing an article, such as a beverage container or can. More specifically, the invention relates to an apparatus for forming a curl or flange on an article.

Conventional machines for forming a curl have required multiple forming heads and forming turrets. Such conventional apparatuses can require significant floor and machine line space. Other conventional curling apparatus require separate machines which may not integrate easily with a machine line, thus slowing down the overall processing time of an article.

It is an object of the invention to have an apparatus that can form a curl or flange on an article, such as a beverage container or can in a machine line that minimizes space and processing time requirements.

SUMMARY

One embodiment of the invention relates to an apparatus for forming a curl on an article. The apparatus comprises: a forming head; and a forming turret including a push ram to load the article into the forming head. The forming head includes a plurality of rollers mounted on a common head. The plurality of rollers includes a first set of rollers configured to form an inner portion of a curl and a second set of rollers configured to form an outer portion of a curl, the curl being formed in a top edge of the article.

Another embodiment of the invention relates to a method of forming a curl in a top edge of an article. The method comprises: feeding an article into a rotating turret; loading the article into a forming head; inserting a first set of rollers into an open end of the article; applying a second set of rollers to an outside surface of a neck of the article along the top edge of the neck; and forming a curl in the top edge of the article.

According to another embodiment of the invention, an apparatus for forming a curl on an article is provided. The apparatus comprises: a means for forming a curl on a top edge of an article; and a forming turret including a means for loading the article into the forming means. The forming means includes a first roller means for forming an inner portion of the curl and a second roller means for forming an outer portion of the curl.

It is to be understood that both the foregoing general description and the following detailed description are exemplary and explanatory only, and are not restrictive of the invention as claimed.

BRIEF DESCRIPTION OF THE DRAWINGS

These and other features, aspects, and advantages of the present invention will become apparent from the following description, appended claims, and the accompanying exemplary embodiments shown in the drawings, which are briefly described below.

FIG. 7(*a*) illustrates the can in the initial position prior to curling. FIG. 7(*b*) illustrates the can after curling in which a top edge of the can has been curled 90 degrees or less from the initial position.

FIG. 8(*a*) is a top, perspective view of a push ram assembly. FIG. 8(*b*) is a top, perspective view of an assembly that may include tooling. FIG. 8(*c*) is a bottom, perspective view of the push ram assembly of FIG. 8(*a*). FIG. 8(*d*) is a bottom, perspective view of the ram assembly of FIG. 8(*b*).

DETAILED DESCRIPTION

An embodiment of the invention relates to an apparatus for providing a curl or flange on an open end of an article. The apparatus comprises a forming head and a forming turret with a push ram to load the article into the forming head. The forming head includes a plurality of independent rollers mounted on a common head. The plurality of rollers includes a first set of rollers configured to form an inner portion of a curl and a second set of rollers configured to form an outer portion of the curl.

According to an embodiment, the second set of rollers are configured to be perpendicular to a neck of the article.

In an embodiment, an open edge of the article is turned greater than 90 degrees from an initial orientation to form a curl.

In an embodiment, an open edge of the article is turned 90 degrees or less from an initial orientation to form a flange at the open end of the article.

In another embodiment, the apparatus further comprises a motor to control the rotation of the forming head. The forming head is capable of rotating in any direction and at any speed.

In an embodiment, each roller in the first set of rollers has a pilot with an extended portion and a groove.

In an embodiment, the angle of the first set of rollers and second set of rollers controls the degree to which the open edge of the article is turned.

An embodiment of the invention relates to a method of forming a curl on an open end of an article. The method comprises: feeding an article into a continuously rotating turret; loading the article into a forming head; inserting a first set of rollers into an open end of the article and applying a second set of rollers to an outside surface of the article to form a curl; withdrawing the article from the forming head; and transferring the article to another turret, discharge track or to another apparatus.

Embodiments of the invention will now be described with reference to the figures.

FIGS. 1-8(*d*) illustrate an apparatus 400 for forming a curl or flange on an article 405. An article 405 may be a can, any suitable food or beverage container, jar, bottle or any other suitable article. The article 405 has an open end, opposite closed end and a sidewall extending from the closed end. Alternatively, the article 405 may be open at both ends. A top, lid or other closure may be added to the article 405 after the curling process.

For exemplary purposes only, the below description will describe the curling apparatus and method for use on a can 405. It will be recognized that any other type of article 405 (such as that described above) may be used.

Figure 3:
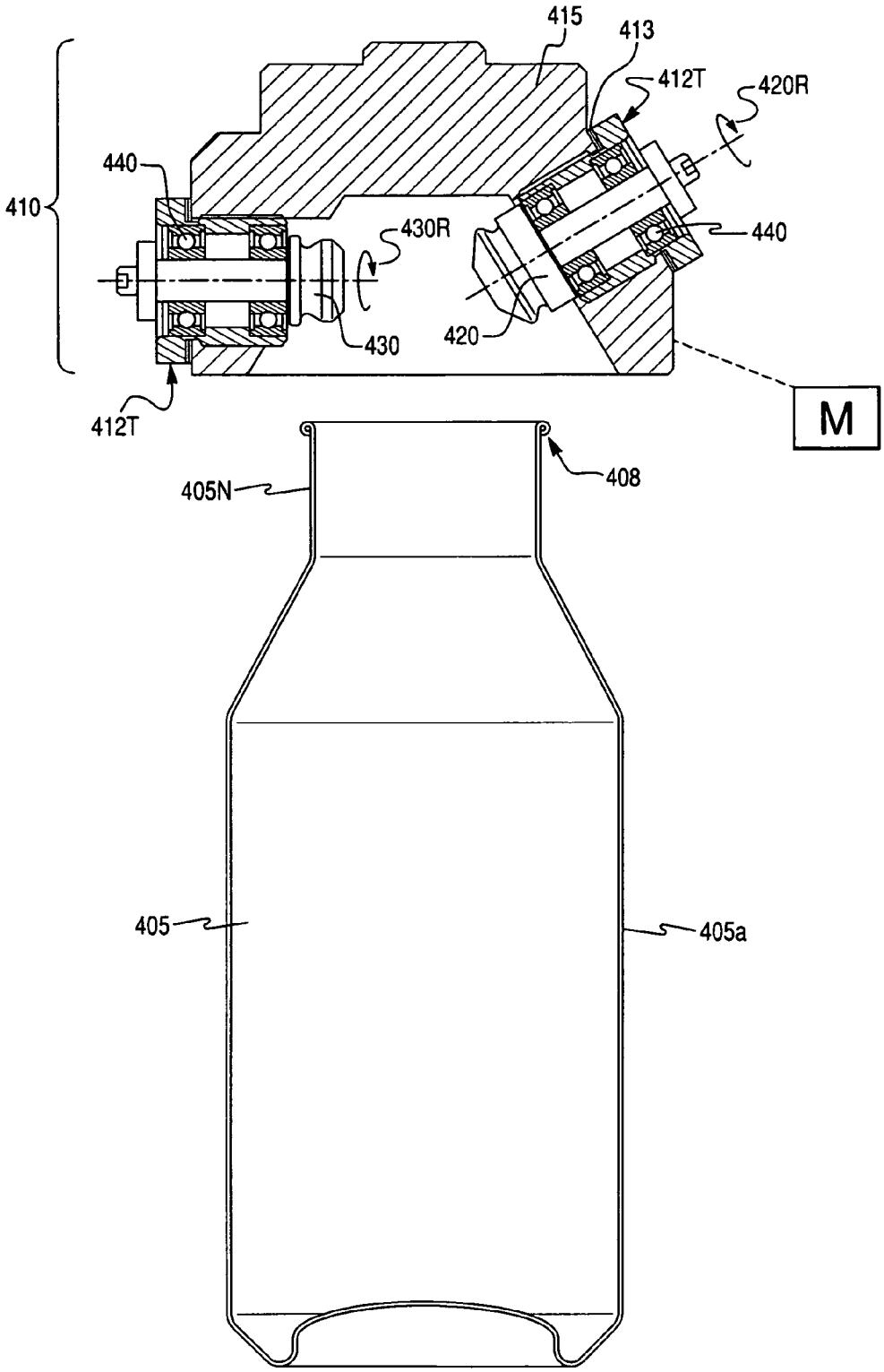
FIG. 3 is a cross-sectional view of a forming head of a curling apparatus with a can.
Figure 4:
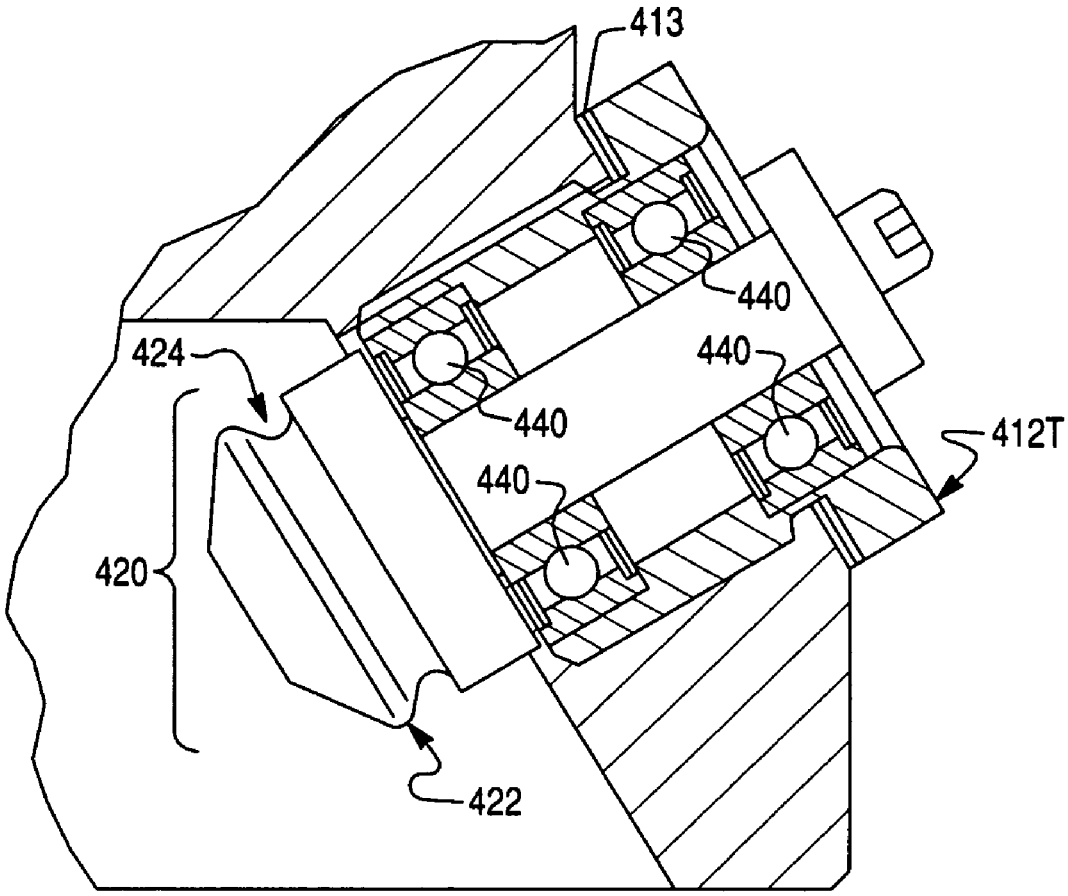
FIG. 4 is a detail view of one roller of the forming head of FIG. 3 and a portion of a can with an edge that has been curled greater than 90 degrees from an initial position.
Figure 4:
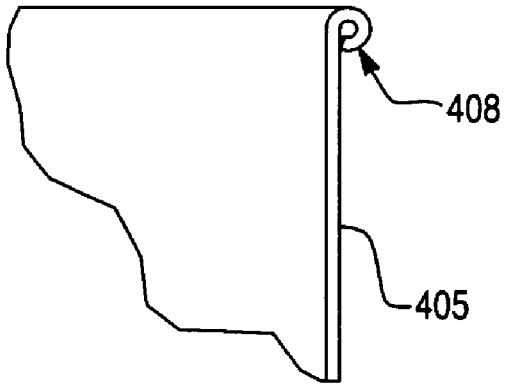
Figure 5:
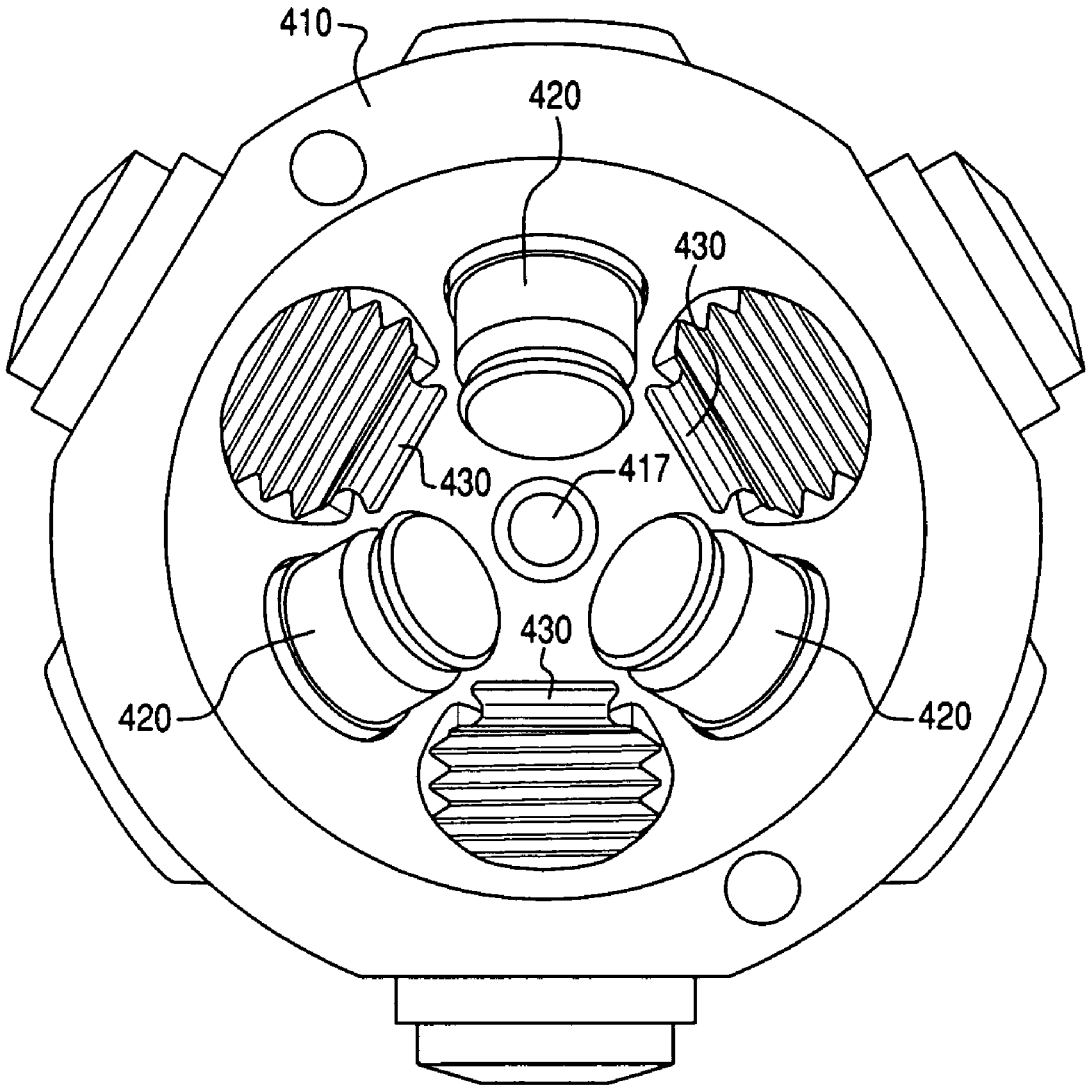
FIG. 5 is a front perspective view of a forming head according to an embodiment of the invention.
Figure 6:
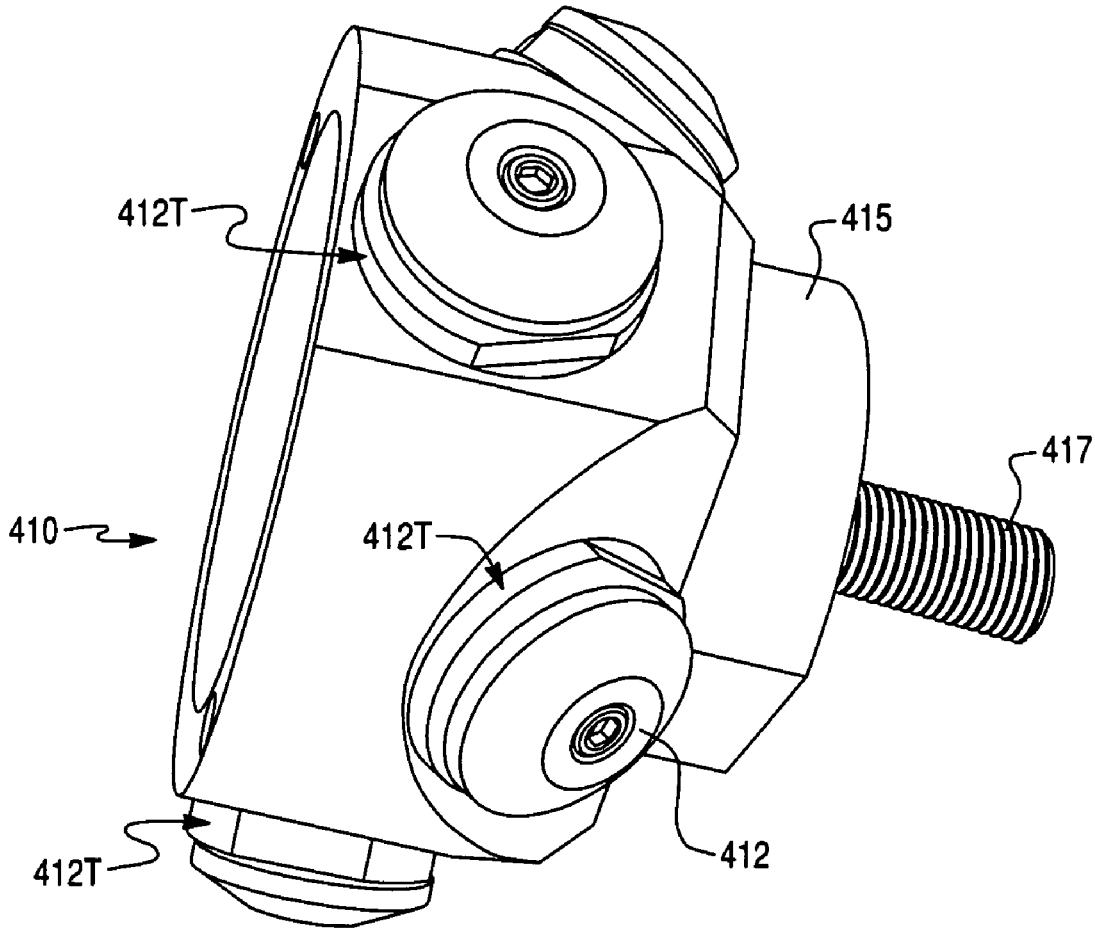
FIG. 6 is a side perspective view of the forming head of FIG. 5.
Figure 7A:
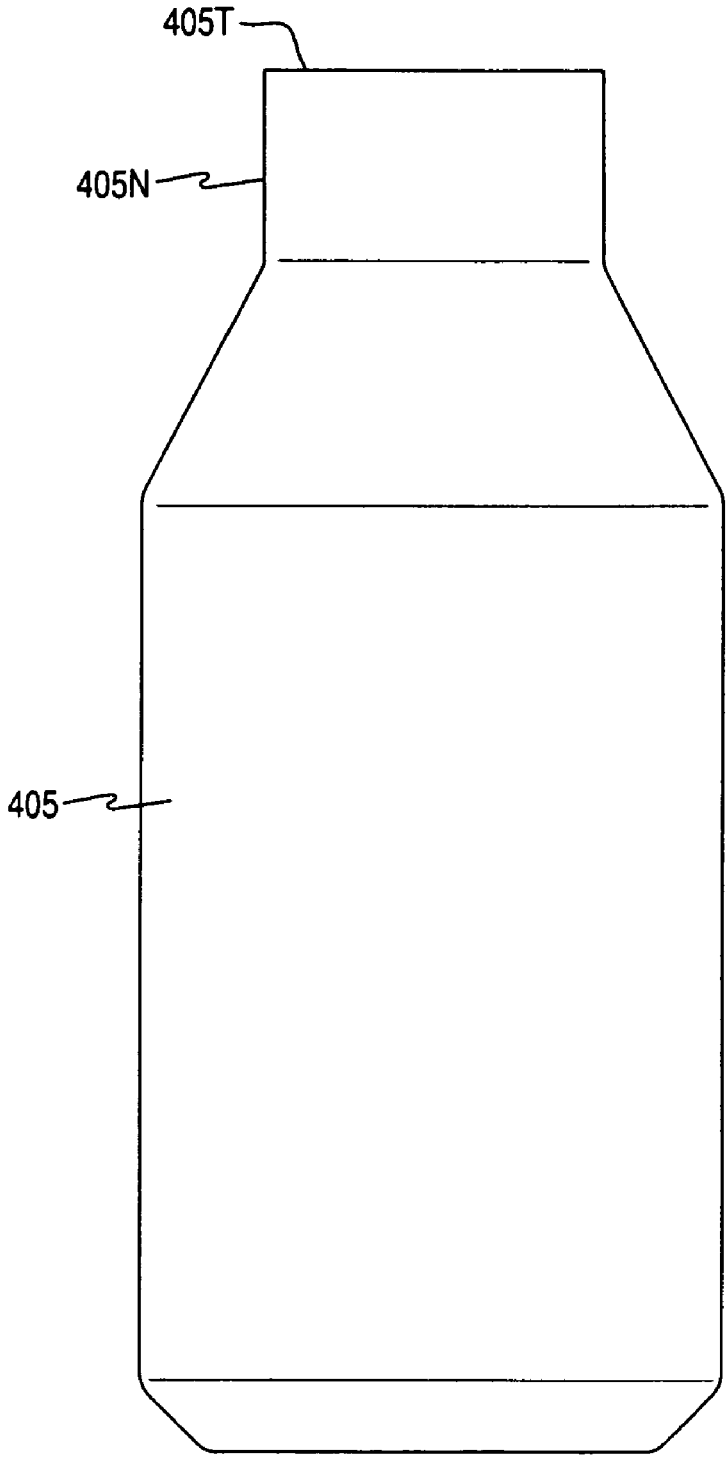
FIGS. 7(*a*) and 7(*b*) are schematic views of a flange on a can formed by the curling apparatus according to another embodiment of the invention.
Figure 7B:
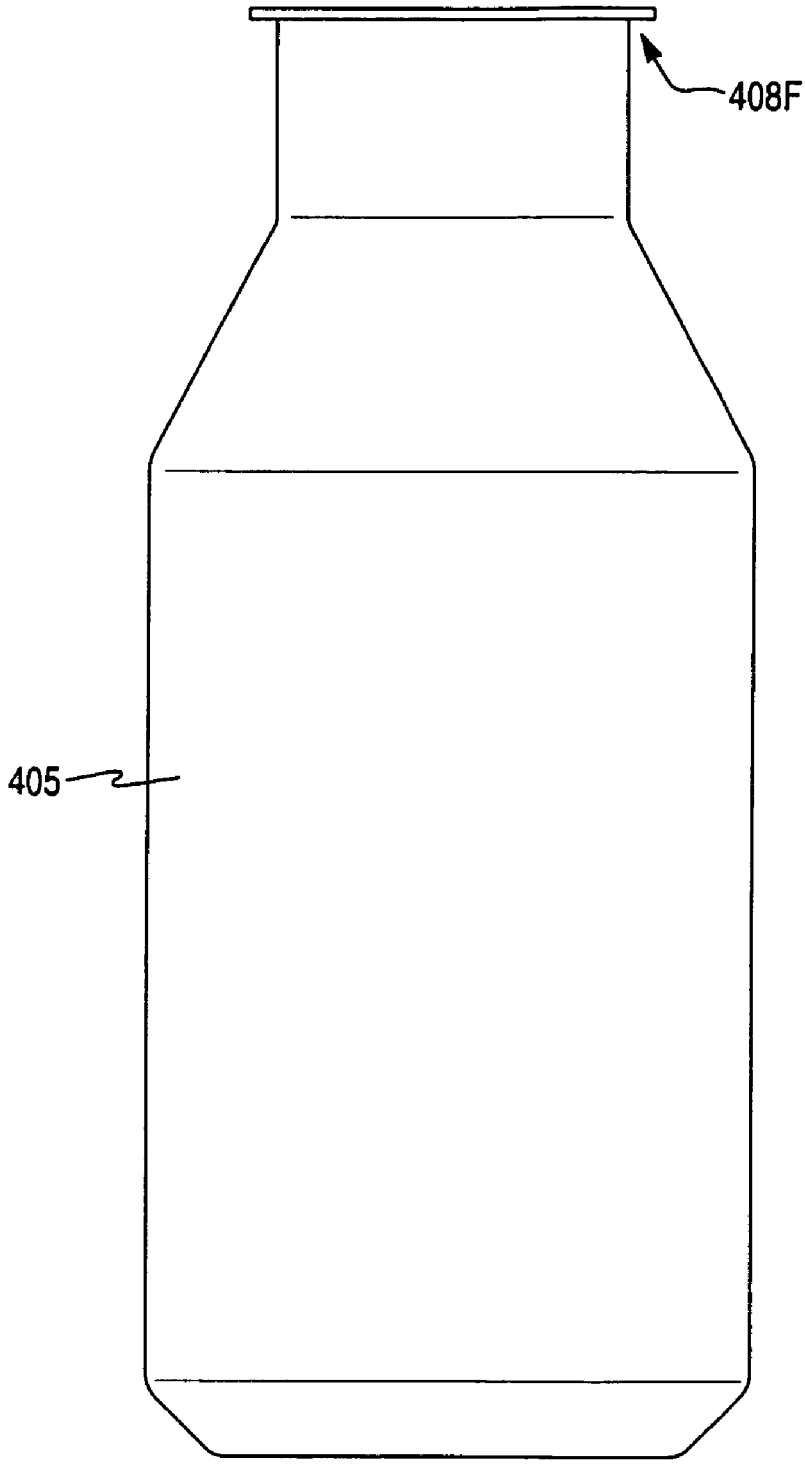
Figure 8A:
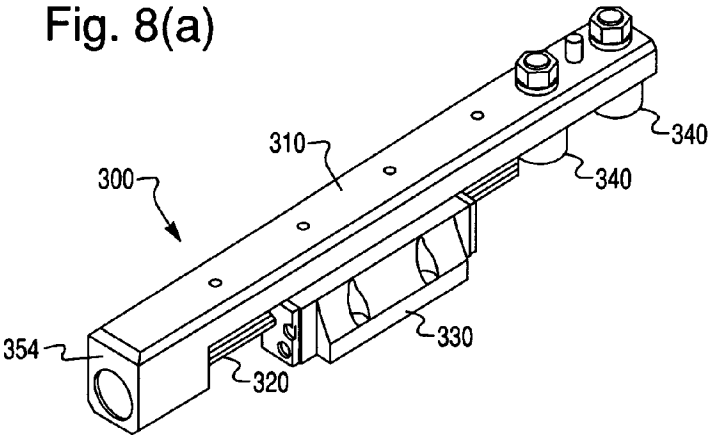
FIGS. 8(*a*) to 8(*d*) are views of a linear ram assembly.
Figure 8B:
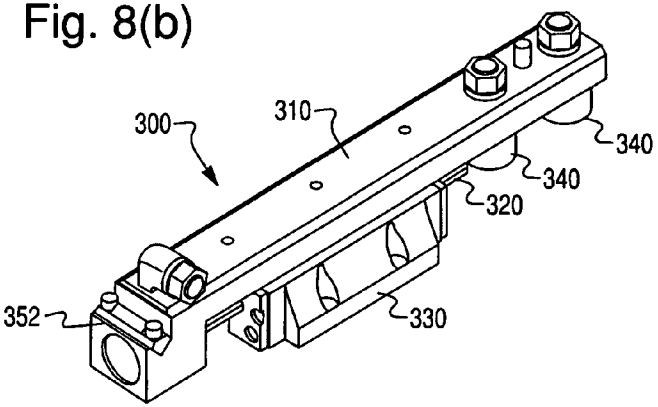
Figure 8C:
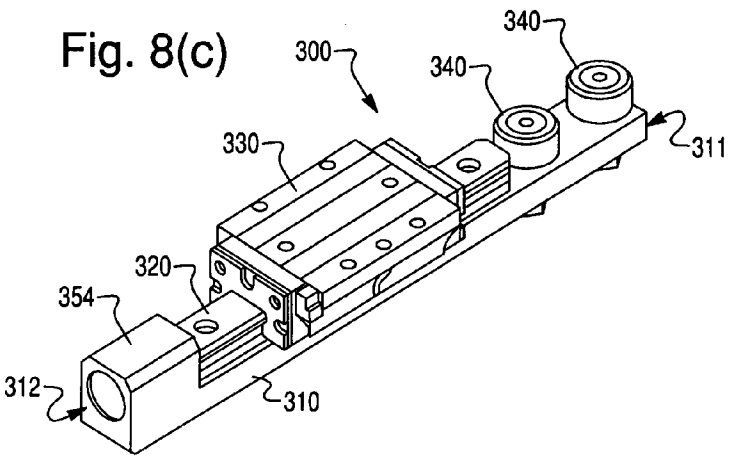
Figure 8D:
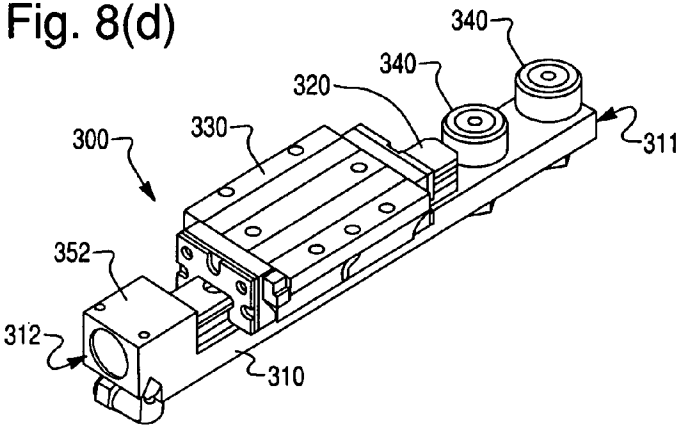

FIGS. 1 to 7(*b*) illustrate a can curling apparatus 400 according to embodiments of the invention. Curling describes a process by which the open end of a can 405 is formed into a rounded, flat or other shape. For example, the forming head 410 may provide a curl comprising a rounded section and/or a flat section. Flanging is sometimes referred to when a curl is formed that turns an open edge of the can 405 approximately 90° or less from its initial orientation, such as shown, for example, in FIG. 7(*b*). Curling can turn the open edge of the can 405 greater than 90° from its normal (initial) orientation, such as shown in FIGS. 3 and 4. However, "curling" may comprise turning the open edge of the can 405 greater than, equal to, or less than 90°.

Figure 1:
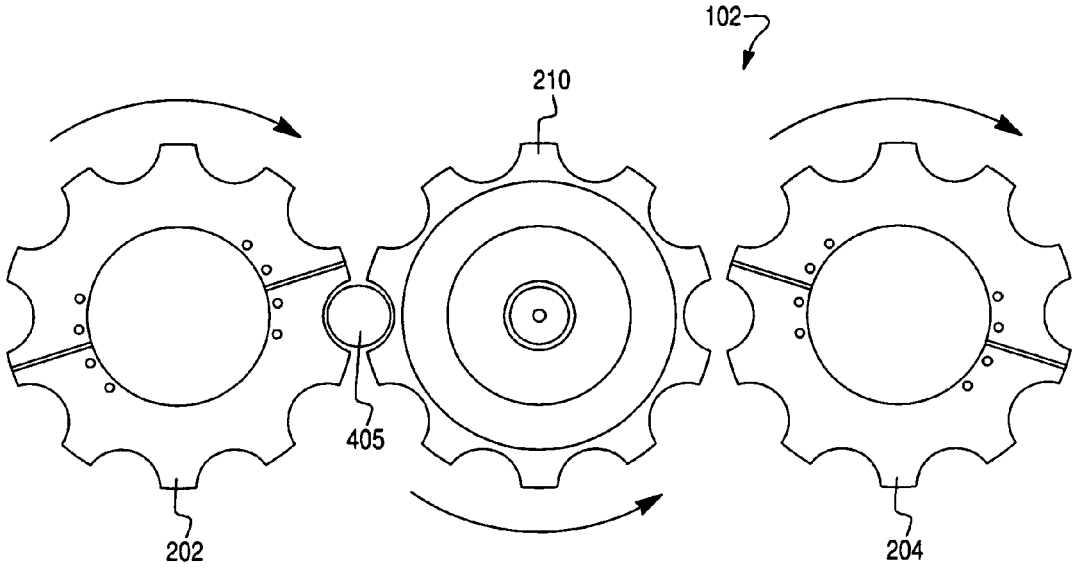
FIG. 1 is a schematic of a machine line with a can curling apparatus according to an embodiment showing an infeed turret, a forming/process turret and a discharge or secondary turret.
Figure 2:
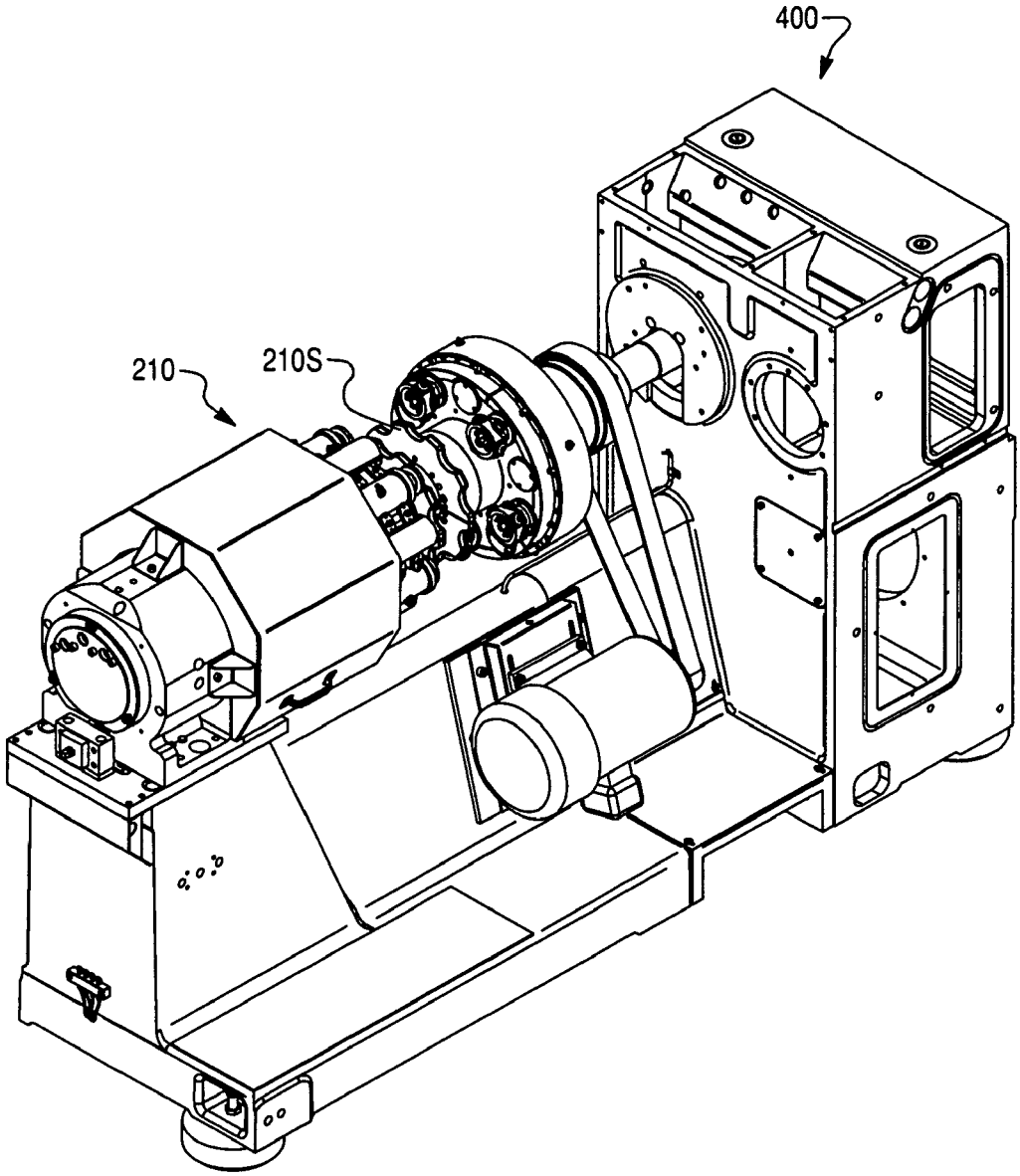
FIG. 2 is a perspective view of the can curling apparatus of FIG. 1.

Cans 405 are fed into a continuously rotating turret (similar to 210) either from an infeed track or from a preceding process turret 202, which may be part of a machine line 102. FIG. 1 illustrates an infeed turret start wheel 202 passing a can 405 to the continuously rotating turret star wheel 210 of the can curling process. While the turret 210 is rotating with the can 405 loaded into a forming station therein, the can 405 will be inserted into a forming head 410 (see FIG. 3 and 4) where an end of the can 405 will be reshaped by rollers 420, 430 and then withdrawn. The can 405 is then transferred from the expansion turret 210 onto another process turret or a discharge track 204, in the direction illustrated by the arrows in FIG. 1.

The apparatus, according to an embodiment, comprises an infeed vacuum transfer wheel 202, the forming turret 210 (or a similar turret), and a discharge vacuum transfer wheel 204. Both the infeed and discharge vacuum transfer wheels 202, 204 are similar in design and function. The infeed wheel 202 loads the can 405 into the forming turret 210, and the discharge wheel 204 unloads the can 405 from the forming turret 210.

The cans 405 are held in position on this first transfer star wheel 202 (and other start wheels or turrets) using a pneumatic pressure differential or "suction" as it will be referred to.

The cans 405 are then passed from the first transfer star wheel 202 to a first turret star wheel 210 and enter into the can curling forming process on the can curling machine 400. While the invention is not so limited, embodiments of the invention are such that curling machines 400 constructed as modules. The use of can curling modules allows for the machine line 102 to be assembled/changed to provide as many can curling stages as is required and to allow for the addition of additional stages such as flanging, necking, trimming, expansion, threading, and/or base reforming/reprofiling, which may be added/removed as desired.

In an embodiment, the turret star wheels 202, 210, 204 may be composed of two segments, which are connected to a drive shaft by way of a timing plate. These timing plates are individually adjustable with respect to the respective turret drive shaft in a manner which allows their angular rotational position with respect to the turret drive shaft to be adjusted and then fixed to the degree that the two segments of the turret star wheel which are mounted thereon, are positioned/timed with respect to the transfer star wheels on either side thereof, so that a smooth, continuous, incident-free transfer of cans between the turret star wheels and the respective transfer star wheels, can take place.

As noted above, the transfer star wheels 202, 204 are arranged to hold the cans 405 in position using suction. The star wheels 202, 204 may have a vacuum port formed in a channel portion(s) that are fluidly communicating with a source of vacuum (negative pneumatic pressure) via a suitable manifold. The vacuum is delivered to the vacuum ports, and the surface area of the cans 405, which are exposed to the suction, is increased to a degree that the cans 405 are stably held in position as each can 405 passes below the transfer star wheel axis of rotation.

The forming turret 210 turret comprises a positioning star wheels 210S at the straight wall 405*a* of the can 405, and the forming (curling) tooling 410 at the open end of the can 405. The positioning star wheels 210S help keep the can 405 oriented and aligned with the forming tooling 410 to enable proper curling (forming) of the can 405.

The forming tooling (head) 410 comprises multiple independent rollers 420, 430 mounted on a common head 415. The rollers 420, 430 are mounted on bearings 440 and are free spinning. The rollers 420, 430 are independent such that each roller 420, 430 can spin independently, that is, separately from the other rollers 420, 430 in the forming head 410. Further, each roller in each set of rollers 420, 430 may be adjusted, replaced, altered or repositioned to change the angle of the roller relative to the remaining rollers and/or a neck 405N of the can 405.

The forming head 410 is coaxial with the can 405. The forming head 410 rotates relative to the can 405 so that the rollers 420, 430 are made to travel around the perimeter of the opening of the can 405. The forming head 410 has multiple sets of rollers 420, 430. One set of rollers 420 is shaped to form the inner portion of the curl 408. Another set of rollers 430 is shaped to form the outer portion of the curl 408. The first set of rollers 420 is configured to be inserted into the inside of the can 405 and work against an inner surface of the can 405. The second set of rollers 430 is configured to work against an outer surface of the can 405. It will be recognized that in another embodiment, the rollers 420, 430 may work against the inner surface, outer surface and/or or both surfaces of the can 405.

The inner rollers 420 have an extended portion 422 and a groove 424 that centers the can 405 to the forming head 410 and one or both (422 and/or 424) can act as a pilot to orient the can 405 relative to the rollers 420, 430. Alternatively, the tapered shape of the rollers 420 may acts as a pilot to guide the can 405 into the forming head 410. The forming head, in an embodiment, may be configured to contain a pilot to orient the can 405 relative to the rollers 420, 430. The interior shape of the forming head 410 may be configured to act as a pilot. For example, as shown in FIG. 3, he interior, tapered shape of the forming head 410 can pilot (or guide) the can 405 into proper alignment within the forming head 410 and into with the rollers 420, 430.

The can 405 is moved by the push ram assembly such that the open edge of the can 405 is positioned adjacent to the groove 424. When the can 405 is aligned relative to the rollers 420, 430, including the groove 424, the rollers 420, 430 spin on opposite sides of the neck 405N of the can 405, thus turning an edge 405T of the neck 405N into a curl 408 or flange 408F (see FIG. 7(*b*)). During this moment in the process, the turret 210 is continuously moving with the can 405 and the can 405 is moving axially into the forming head 410 and, thus, between the rotating rollers 420, 430 to form the curl 408.

Due to the similarity between the processes, the methods and apparatus described here can apply to a flanging process. In flanging, the use of two different shaped rollers 420, 430 can be used to control the shape and size of the flange 408F. For example, the open edge of the can 405 can be turned 90 degrees or less to form a flange 408F.

In an embodiment, the first set of rollers 420 includes three rollers and the second set of rollers 430 includes three rollers. In another embodiment, the first set of rollers 420 may include four rollers and the second set of rollers 430 may include two rollers. It will be recognized that any number and combination of rollers may be used. For example, the first set 420 and second set 430 may have equal amounts of rollers. Alternatively one of the first and second sets 420, 430 may have a greater amount of rollers.

In an embodiment, the rollers in the second set of rollers 430 may be perpendicular to a neck 405N of the can 405. The rollers in the first set of rollers 420 may be at approximately a 45 degree angle to a neck 405 N of the can 405.

In another embodiment, the axis of rotation 420R of the rollers in the first set of rollers 420 are at approximately a 45 degree angle to the axis of rotation 430R of rollers in the second set of rollers 430.

In an embodiment, the size of the forming head 410 and rollers 420, 430 may vary according to the size of the can.

It will be recognized that the rollers 420, 430 may be independent of each other or may be linked.

In another embodiment, the apparatus 400 further comprises a motor M to control the rotation of the forming head 410. The forming head 410 is capable of rotating in any direction and at any speed.

In an embodiment of the invention, the radial position of the rollers 420, 430 can be set independently to control the inner and outer profile of the curl 408. The radial position of the rollers 420, 430 can be set by an adjustment mechanism 412. The adjustment mechanism 412 (see FIG. 6), may also allow each roller 420, 430 to be removed and switched so that each forming head 410 may utilize interchangeable rollers 420, 430. The adjustment mechanism 412, according to an embodiment, comprises a threaded body (bolt, screw, or other suitable mechanism) 412T that may be, for example, set in shims 413.

In an embodiment, the angle of the first set of rollers 420 can determine the degree to which the open edge of the can 405 is turned (shape of the curl 408).

In another embodiment, the forming head 410 may be attached to the forming turret 210 by a fastener 417. For example, the fastener 417 can comprise a threaded fastener (bolt, screw, or other suitable mechanism) which attaches to the turret 210. Alternatively, any other suitable fastener 417 may be use. The fastener 417 allows the forming head 410 to be switched for a differently configured forming head 410.

In an embodiment, the curling (forming) head 410 is actuated by a linear slide assembly with a cam and cam follower, such as shown in FIGS. 8(*a*) to 8(*d*). The linear slide assembly 300 comprises a slide block 330 containing rolling elements (such as ball bearings, not shown) and a profiled rail 320, which slides in the slide block 330. According to an embodiment, the slide block 330 is fixed and the profiled rail 320 is capable of moving in a linear manner. This mounting gives us a more compact design for the entire ram assembly 300 while maintaining the load at the center of the rolling elements. The mounting may also reduce the mass of the moving components. The rail is "profiled" due to its shape. The rail 320 has been cut or formed into the outline (profile) shown in FIGS. 8(*a*) to 8(*d*) and, thus, is a profiled rail. Alternatively, the rail 320 may be cut or formed into any other suitable shape (profile).

In addition to the slide block 330 and profiled rail 320, the assembly 300 includes an adaptor 310 mounted to the profiled rail 320. On one end 311 of the adaptor 310 there are provisions for mounting cam followers 340. On the other end 312 of the adaptor 310 there are provisions for mounting either a base plate, or push plate (which would be assembled with component 354 on the adaptor 310) to move the can 405 into alignment with the curling tool 240, such as shown in FIGS. 8(*a*) and 8(*c*). Alternatively, the end 312 of the adaptor 310 may be assembled with other tooling, such as curling tooling (which would be assembled with component 352 on the adaptor 310), such as shown in FIGS. 8(*b*) and 8(*d*).

The cam followers 340 follow a cam (not shown) positioned on a cam support 375 on a shaft. The structure of the assembly 300 allows for approximately a 4.0 inch or more stroke while maintaining a rigid (inflexible) support at the end 312 of the adaptor and/or profiled rail 320.

It will be recognized that the "curl" with flat and/or rounded sections may be formed in an open edge of the can 405 in one curling operation. Thus, a single forming head 410 may produce the appropriate curl with flat and/or rounded sections.

It will be recognized that the can curling mechanism may utilize any other suitable ram assembly. It will also be recognized that any combination of embodiments, figures and components is possible.

Given the disclosure of the present invention, one versed in the art would appreciate that there may be other embodiments and modifications within the scope and spirit of the invention. Accordingly, all modifications attainable by one versed in the art from the present disclosure within the scope and spirit of the present invention are to be included as further embodiments of the present invention. The scope of the present invention is to be defined as set forth in the following claims.

What is claimed is:

1. An apparatus for forming a curl on an article comprising:

a forming head; and a forming turret including a push ram to load the article into the forming head, wherein the forming head includes a plurality of rollers mounted on a common head, the plurality of rollers includes a first set of rollers configured to form an inner portion of a curl and a second set of rollers configured to form an outer portion of a curl, the curl being formed in a top edge of the article, and wherein the forming head is continuously rotating with the forming turret.

2. The apparatus according to claim 1, wherein the first set of rollers comprises one or more rollers.

3. The apparatus according to claim 1, wherein the second set of rollers comprises one or more rollers.

4. The apparatus according to claim 1, wherein rollers in the second set of rollers are perpendicular to a neck of the article.

5. The apparatus according to claim 1, wherein rollers in the first set of rollers are at approximately a 45 degree angle to a neck of the article.

6. The apparatus according to claim 1, wherein rollers in the first set of rollers are at approximately a 45 degree angle to the axis of rotation of rollers in the second set of rollers.

7. The apparatus according to claim 1, wherein the first and second set of rollers turn the top edge of the article greater than 90 degrees from an initial position to form a curl.

8. The apparatus according to claim 1, wherein the first and second set of rollers turn the top edge of the article 90 degrees or less from an initial position to form a curl.

9. The apparatus according to claim 1, wherein the first and second set of rollers turn the top edge of the article to form a curl comprising a flat section and a rounded section.

10. The apparatus according to claim 1, further comprising a motor to control the rotation of the forming head.

11. The apparatus according to claim 1, wherein rollers in the first set of rollers each comprise a pilot with an extended portion and a groove.

12. The apparatus according to claim 1, wherein the angle of rollers in the first set of rollers relative to the axis of rotation of rollers in the second set of rollers determines the angle of a curl in the top edge of the article.

13. The apparatus according to claim 1, wherein the forming head includes a pilot portion to align the article within the forming head.

14. A method of forming a curl in a top edge of an article comprising:

feeding an article into a rotating turret;

loading the article into a forming head;

inserting a first set of rollers into an open end of the article;

applying a second set of rollers to an outside surface of a neck of the article along the top edge of the neck;

forming a curl in the top edge of the article; and continuously rotating the forming head with the turret.

15. The method according to claim 14, further comprising the steps of:

withdrawing the article from the forming head; and transferring the article to a second turret, a discharge track or a different apparatus.

16. The method according to claim 14, wherein the turret is continuously rotating.

17. The method according to claim 14, wherein the first set of rollers comprises one or more rollers.

18. The method according to claim 14, wherein the second set of rollers comprises one or more rollers.

19. The method according to claim 14, wherein rollers in the second set of rollers are perpendicular to the neck of the article.

20. The method according to claim 14, wherein rollers in the first set of rollers are approximately at a 45 degree angle to the neck of the article.

21. The method according to claim 14, wherein rollers in the first set of rollers are at approximately a 45 degree angle to the axis of rotation of rollers in the second set of rollers.

22. The method according to claim 14, wherein the first and second set of rollers turn the top edge of the article greater than 90 degrees from an initial position to form a curl.

23. The method according to claim 14, wherein the first and second set of rollers turn the top edge of the article 90 degrees or less from an initial position to form a curl.

24. The method according to claim 14, wherein rotation of the turret is controlled by a motor.

25. The method according to claim 14, wherein the first and second set of rollers turn the top edge of the article to form a curl comprising a flat section and a rounded section.

26. The method according to claim 14, further comprising the step of adjusting the angle between rollers in the first set of rollers to the axis of rotation of rollers in the second set of rollers to determine the angle of a curl in the top edge of the article.

27. The method according to claim 14, further comprising the step of guiding the can into the forming head during loading with a pilot portion.

28. The method according to claim 27, wherein the rollers in the first set of rollers includes the pilot portion, the pilot portion comprising an extended portion and a groove.

29. The method according to claim 27, wherein the forming head includes the pilot portion.

30. An apparatus for forming a curl on an article comprising:

a means for forming a curl on a top edge of an article; and a forming turret including a means for loading the article into the forming means, wherein the forming means includes a first roller means for forming an inner portion of the curl and a second roller means for forming an outer portion of the curl, and wherein the forming means is continuously rotating with the forming turret.

31. The apparatus according to claim 30, wherein the first and second roller means turn the top edge of the article greater than 90 degrees from an initial position to form a curl.

32. The apparatus according to claim 30, wherein the first and second roller means turn the top edge of the article 90 degrees or less from an initial position to form a curl.

33. The apparatus according to claim 30, further comprising a motor to control the forming means.

* * * * *